US005543028A

United States Patent [19]

Herbert et al.

[11] Patent Number: 5,543,028

[45] Date of Patent: Aug. 6, 1996

[54] ELECTROFORMING SEMI-STEP CAROUSEL, AND PROCESS FOR USING THE SAME

[75] Inventors: William G. Herbert, Williamson; Patricia Bischoping, Webster; Robert P. Altavela, Farmington; Lawrence Kotowicz, Rochester; Peter J. Schmitt, Ontario, all of N.Y.; Ronald E. Jansen, Palm City, Fla.; John H. Lennon, Canandaigua, N.Y.; Henry G. Grey, Las Vegas, Nev.

[73] Assignee: Xerox Corporation, Stamford, Conn.

[21] Appl. No.: 347,110

[22] Filed: Nov. 23, 1994

(Under 37 CFR 1.47)

[51] Int. Cl.[6] ..... C25D 1/00

[52] U.S. Cl. ..... 205/70; 205/67; 204/225; 204/228; 204/242

[58] Field of Search ..... 204/228, 281, 204/242, 225; 205/67, 70

[56] References Cited

U.S. PATENT DOCUMENTS

| | | | |
|---|---|---|---|
| 3,560,349 | 2/1971 | Mattia | 205/73 |
| 3,669,849 | 6/1972 | Schmidt | 204/11 |
| 3,844,906 | 10/1974 | Bailey et al. | 204/238 |
| 3,876,510 | 4/1975 | Wallin et al. | 204/281 |
| 4,024,045 | 5/1977 | Thierstein | 204/281 |
| 4,067,782 | 1/1978 | Bailey et al. | 204/25 |
| 4,323,433 | 4/1982 | Loch | 204/279 |
| 4,478,769 | 10/1984 | Pricone et al. | 205/70 |
| 4,501,646 | 2/1985 | Herbert | 204/4 |
| 4,530,739 | 7/1985 | Hanak et al. | 204/4 |
| 4,734,179 | 3/1988 | Trammel | 204/199 |
| 4,851,098 | 7/1989 | Kimura et al. | 204/225 |
| 4,879,007 | 11/1989 | Wong | 204/225 |
| 4,902,386 | 2/1990 | Herbert et al. | 204/281 |
| 5,156,863 | 10/1992 | Pricone et al. | 425/363 |

*Primary Examiner*—John Niebling
*Assistant Examiner*—Kishor Mayekar
*Attorney, Agent, or Firm*—Oliff & Berridge

[57] ABSTRACT

An electroforming/electrodeposition process and apparatus includes a first electrode, a second electrode spaced from the first electrode, a channel defined by the first and second electrodes and at least one electrically nonconductive or poorly conductive shield disposed adjacent at least one electrode. The shield(s) define(s) a region of the channel wherein the surface of a mandrel placed in that region experiences substantially uniform current density. The apparatus may contain additional electroforming/electrodeposition and/or other steps and may be arranged in a carousel apparatus with one or more mandrels to permit continuous operation of the apparatus.

26 Claims, 5 Drawing Sheets

ELECTROFORMING SEMI-STEP CAROUSEL, AND PROCESS FOR USING THE SAME

BACKGROUND OF THE INVENTION

This invention relates to an apparatus for continuous electroforming/electrodeposition, and a process for using the same. More particularly, this invention relates to a semi-step carousel electroforming/electrodeposition apparatus that permits rapid, continuous and automated processes for electroforming or electrodepositing metal or metal alloys on mandrel surfaces. The products produced by the apparatus and process of the present invention may be utilized in a broad range of finished articles. For example, the products produced by the present invention may be used for electrostatic imaging members, endless and seamless electrostatographic belts, tensile segments for continuously variable transmission belts, reinforcement members for conventional "V" belts, timing belts and flat belts, donor rolls, fuser rolls, etc.

Electroforming, electrodeposition and electroplating methods and apparatus are well known in the art. For example, U.S. Pat. No. 4,067,782 discloses a process for nickel plating a cylindrically shaped hollow core mandrel. The mandrel is suitable for chromium plating and for use in an electroforming process for the production of endless, seamless belts for electrostatographic applications. The process comprises anodizing a hollow aluminum core, nickel plating the anodized core, optionally subjecting the plated core to an acid dip bath and thereafter plating the core with chromium.

U.S. Pat. No. 4,501,646 discloses an electroforming process comprising providing a mandrel having certain coefficient of expansion characteristics and length to segmental cross-sectional area ratios in an electroforming bath to electroform a coating of a metal on the core mandrel and thereafter removing the coating under certain cooling conditions.

U.S. Pat. No. 3,844,906 discloses a process for forming seamless nickel belts on a mandrel and removing the nickel belt from the mandrel under certain cooling conditions.

U.S. Pat. No. 4,024,045 describes a master pattern cylinder comprising a roller body and a sleeve surrounding the roller body. In one embodiment, a thin-walled sleeve is described having an outer surface which is cylindrical and an inner surface which is frustum-shaped. In another embodiment, a roller body is fitted with a thin-walled sleeve having cylindrical inner and outer surfaces. The mandrel may be employed for producing perforated nickel sleeves by electrolytic deposition.

U.S. Pat. No. 4,530,739 describes a method of fabricating an electroplated substrate. The substrate is prepared in an electroforming process by electroplating onto and removing a metallic layer from the surface of a specially prepared mandrel. The surface of the cylindrical mandrel is substantially defect-free and may either be textured or smooth prior to electroplating a metallic layer thereon.

U.S. Pat. No. 3,669,849 discloses an electrodeposition process using a mandrel having a surface with recessed areas, and a means for facilitating electrodeposition in the recessed areas.

Use of a carousel apparatus for electroplating articles is also known in the art. For example, U.S. Pat. No. 4,734,179 discloses a carousel electroplating apparatus used to plate copper onto cast or swaged lead alloy bullet cores. The carousel apparatus contains positions for placing each of multiple bullet cores between two respective unshielded anodes, and the entire carousel apparatus is suspended in an electrolytic bath to complete the electrodeposition process. After the electrodeposition is completed, the carousel apparatus is removed from the electrolytic solution, and the plated bullet cores are removed.

Use of shielding around electrodes in an electroforming process is also generally known in the art. For example, U.S. Pat. No. 4,902,386 discloses the use of shades and/or varying porosity screens that can be positioned within the electroplating bath to control the plated coating thickness on the mandrel. Similarly, use of shields in an electrodeposition tank is disclosed in U.S. Pat. Nos. 4,478,769 and 5,156,863. These patents disclose that a shield of non-conductive material may be placed between the electrode and the mandrel to control the deposition of metal ions on the mandrel surface.

The conventional electrodeposition processes, however, possess several problems and disadvantages. For example, conventional processes using a carousel apparatus do not allow for the independent control of thicknesses on each individual mandrel so as to allow the production of different products in the same carousel. Furthermore, conventional carousels often are very large and are therefore not conducive to large scale industrial application. Conventional electrodeposition methods also exhibit problems in creating products which have a uniform thickness.

A further problem with conventional electrodeposition methods is that such methods using nonrotating mandrels have only limited applications. Processes using nonrotating mandrels may be preferred, for instance, so as to eliminate the need for additional moving parts in the apparatus and the associated maintenance of those parts and to ease the fabrication of product materials. Additionally, use of rotating mandrels requires that electricity be transmitted through the rotating member, which can cause arcing and sparking, which can accelerate wear and the need for maintenance of the apparatus. However, conventional processes using nonrotating mandrels are severely limited. For example, such processes are limited to electroforming or electroplating mandrels having a diameter less than about one inch. If larger diameter mandrels are to be used, the apparatus becomes exceptionally large, requiring an anode-to-mandrel distance of up to four feet or more.

SUMMARY OF THE INVENTION

The present invention provides a semi-step carousel apparatus and a process for the continuous electroforming or electrodeposition of metals or metal alloys on mandrels. Such apparatus and process overcome disadvantages and problems of conventional processes by providing a much smaller apparatus while providing a continuous process which is more conducive to large scale industrial application. The present invention also permits the use of nonrotating mandrels without the corresponding dramatic increase in size of the electrolytic cell.

The present invention also provides an apparatus capable of accommodating multiple connector arms, each of which may move independently of the others. Each connector arm may also be equipped with separate current control devices, thus allowing for multiple, different electroformed articles to be produced with the same apparatus.

The present invention also provides an electrolytic cell, and electrodeposition process, which utilizes shielded anodes. This allows for a dramatic decrease in the size requirements of the apparatus, while increasing the quality of the electroformed article.

In preferred embodiments, this invention provides an apparatus for depositing metal or metal alloy on a mandrel comprising:

(a) a first electrode;

(b) a second electrode spaced from the first electrode;

(c) a channel defined by the first electrode and the second electrode;

(d) a first electrically nonconductive or poorly conductive shield disposed adjacent the first electrode;

(e) a second electrically nonconductive or poorly conductive shield disposed adjacent the second electrode and disposed opposite the first shield; and (f) a first region in the channel between the first shield and the second shield wherein the surface of a mandrel placed in said first region experiences substantially uniform current density.

The electroforming process of the present invention is particularly useful for the production of electrostatic imaging members, endless and seamless electrostatographic belts, tensile segments for continuously variable transmission belts, reinforcement members for conventional "V" belts, timing belts and flat belts, donor rolls, fuser rolls, etc.

DETAILED DESCRIPTION OF PREFERRED EMBODIMENTS

Figure 1:
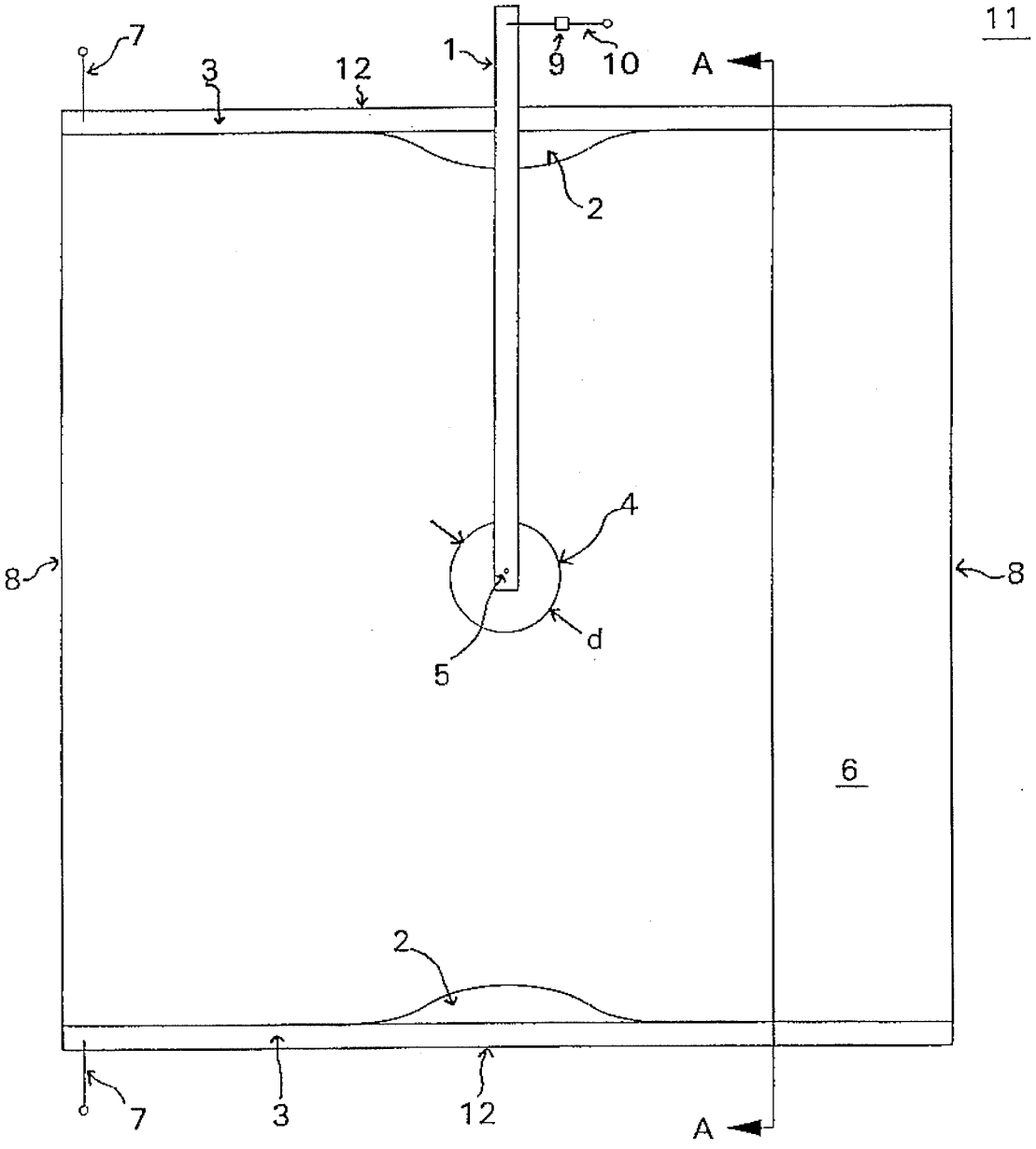
FIG. 1 is a schematic illustration of an electrolytic cell of an embodiment of the present invention having two anode electrodes.

The electroforming/electrodeposition process of the present invention generally comprises electrodepositing metals or metal alloys onto a mandrel in an electrolytic cell.

In one embodiment of the present invention, the electrolytic cell comprises a first anode electrode and a second anode electrode spaced a given distance from the first anode electrode, thereby defining a channel between the first anode electrode and the second anode electrode. A first shield is disposed adjacent a portion of the first anode electrode to serve as a shield to a portion of the electrode. A second shield is disposed adjacent a portion of the second anode electrode and opposite the first shield to serve as a shield to a portion of the second anode electrode. The shields are placed such that they form a region in the channel between the first and second anode electrodes such that the surface of a mandrel placed in that region experiences substantially uniform current density.

In a second embodiment of the present invention, the electrolytic cell comprises a first wall which also functions as an electrode in the cell. The cell further contains a second wall spaced opposite the first wall to define a channel between the first and second walls. A shield is disposed adjacent a portion of the first wall, thereby creating a region in the channel such that the surface of a mandrel placed in that region experiences substantially uniform current density.

A feature of the present invention is that several electrolytic cells may be combined in a loop to create an electrodeposition apparatus capable of continuous operation. The number of cells which may be so combined may range from two to an almost unlimited number, constrained only by practical considerations such as apparatus size, the desired thickness of the electroform and other industrial considerations. When various electrolytic cells are combined in such a manner, it will often be desirable to also include steps for cleaning the mandrel, soaking the mandrel to achieve a mandrel temperature equal to the temperature of the electrodeposition solution, rinse the electroform and mandrel after electrodeposition is completed, cool the electroform and mandrel to a lower temperature, and remove the electroform from the mandrel. Although the present invention provides an advantageous means of combining such additional steps with the electroforming steps, such additional steps are not necessary to carry out the electroforming process of the present invention.

If several electrolytic cells are to be arranged in sequence, they may be arranged in such a fashion to accommodate the particularities of space limitations, articles to be electroformed and specific electrolytic solutions to be utilized. For example, the electroforming steps and any additional steps may be arranged in a circular fashion (such as in the form of a carousel) or the various steps could be arranged in an oval, ellipsoid, or even a straight line arrangement.

When two or more individual electrolytic cells are connected together, the resulting structure may take the appearance of connected individual cells, or an elongated single cell. For example, if two cells are connected at their side walls (the walls perpendicular to the anode walls), the common wall may be retained or removed. If the common wall is retained, then the connecting arm supporting a mandrel must be lifted out of the first cell, moved over the intervening wall, and lowered into the second cell. In this arrangement, the cells could be of identical or different design (shield design, number of anodes, electrolyte solution composition, etc.). If the common wall is removed, then the remaining structure may take the appearance of a single electrolytic cell, having multiple shields adjacent to the respective anodes and either a single anode extending the entire length of the combined cells or multiple anodes spanning the cell length. Here, the connecting arm could either remove the mandrel from the solution or leave the mandrel in the solution when proceeding from one electrodeposition region to the next. Although in this case the electrolyte solution would be the same in each region, each region may have identical or different number of anodes, shield designs, etc. However, the electrodeposition regions where the mandrel will be located must be spaced a sufficient distance apart, as described below.

In one embodiment of the present invention, several electrodeposition steps are combined with additional pre- and post-electrodeposition steps to form a carousel arrangement. In this embodiment, a mandrel proceeds through the following steps to enable continuous operation of the apparatus: 1) clean the mandrel in a cleaning solution; 2) soak the mandrel in a portion of the electrolytic solution to raise the mandrel temperature to the temperature of the electrodeposition solution; 3) expose the mandrel to the electrodeposition solution and activate current to the electrolytic cell to permit electrodeposition to proceed so as to form the electroform on the surface of the mandrel; 4) rinse the electroform and mandrel in an appropriate rinse solution to remove excess electrodeposition solution; 5) cool the electroform and mandrel to a lower temperature; 6) rinse the electroform and mandrel in a rinse solution; and 7) remove the electroform from the mandrel. After the electroform is removed from the mandrel, the mandrel proceeds to the cleaning step, and the sequence begins again.

Mandrels which may be used in the present invention are known in the art. For example, U.S. Pat. No. 4,902,386, the entire disclosure of which is incorporated herein by reference, discloses one such mandrel. One skilled in the art will readily recognize that other mandrel designs, commonly used in the electroforming art, may also be used in the present invention.

The mandrels used in the present invention may optionally be plated with a protective coating, depending upon the composition of the mandrel and the composition of the electrolyte solution to be electrodeposited onto the mandrel. If the mandrel is to be plated with a protective coating, typical such protective coatings for mandrels include chromium, nickel, alloys of nickel, iron and the like. The plated metal should preferably be harder than the metal used to form the electroform, and at least 0.006 mm in thickness. The outer surface of the plated mandrel should also be passive, i.e., adhesive, relative to the metal that is to be electrodeposited so as to prevent adhesion during electroforming. Other factors that may be considered when selecting the metal for the protective coating include cost, nucleation, adhesion, oxide formation and the like. Chromium plating is a preferred material for the outer mandrel surface because it has a naturally occurring oxide and surface resistive to the formation of a strongly adhering bond with such electrodeposited metals as nickel. However, other suitable metal protective coatings may be used for the mandrels.

If the mandrel core is to be plated with a protective coating, such plating may be conducted using any suitable electrodeposition process, including the process of the present invention. Other processes for plating a mandrel core are known and described in the art. For example, U.S. Pat. No. 4,067,782, the entire disclosure of which is incorporated herein by reference, and U.S. Pat. No. 4,902,386 describe processes for electroplating a protective coating onto a mandrel core.

Electroformed articles may be formed on the mandrels by any suitable electrodeposition solution, current density profile, etc., so long as the apparatus is tailored to and conforms to the process of the present invention. Electrochemical processes for electroforming articles on mandrels are also well known and described in the art. For example, electroforming and electrodeposition processes are disclosed in U.S. Pat. Nos. 4,067,782, 4,501,646, 3,844,906 and 4,530,739, the entire disclosures of which are incorporated herein by reference.

For example, U.S. Pat. No. 3,844,906 discloses an electroplating process which maintains a continuous and stable aqueous nickel sulfamate electroforming solution. The process may be used to form a relatively thin, ductile, seamless nickel belt by electrolytically depositing nickel from solution onto a support mandrel, and then recovering the nickel belt by cooling the nickelplated mandrel and removing the electroform. The disclosed process utilizes a nickel anode, a cathodic mandrel and a nickel sulfamate solution maintained at a temperature of from about 140° F. to about 160° F. and having a current density ranging from about 200 amps/ft$^2$ to about 500 amps/ft$^2$.

Although the above discussion of mandrels and process characteristics references electroforming an article on a mandrel surface, removing the electroformed article and then reusing the mandrel, the process is not limited as such. One skilled in the art will readily recognize that the process of the present invention could also be practiced, with minimal or no routine experimental work, to electroplate a metal or metal alloy on the surface of an item which functions as a mandrel, wherein the plating is not removed from the mandrel.

The electroforming process of this invention may be conducted in any suitably designed electroforming device incorporating the features and characteristics described herein. For example, a cylindrically shaped mandrel may be suspended vertically in an electrodeposition tank. The electrically conductive mandrel plating material should be compatible with the metal electrodeposition solution. The top and/or bottom edges of the mandrel may be masked off with a suitable non-conductive material, such as wax, to prevent deposition on those areas, if desired. The tank is filled with a metal electrodeposition solution and the temperature of the solution is maintained at the desired temperature. The mandrel, attached to a connecting arm, is immersed in the solution, preferably parallel to the orientation of the anodes. Either the tank or preferably the mandrel connecting arm may be vertically and horizontally movable to allow the mandrel to move into and out of the electrodeposition solution.

A current can be supplied from a suitable DC source. The positive end of the DC source may be connected to the anodes and the negative end of the DC source may be connected to the connector arm. The electroplating current passes from the DC source to the anode, to the electrodeposition solution, to the mandrel, to the connector arm, and back to the DC source. In operation, the mandrel is lowered into the electroplating tank and a layer of electroformed metal is deposited on the mandrel's outer surface. The mandrel may be continuously rotated about its vertical axis while immersed in the electroplating tank, such as by suitable drive means attached to the connector arm. However, when appropriate shielding of the anodes is conducted in accordance with embodiments of the present invention, excellent results may be achieved using a mandrel which does not rotate in the electrodeposition tank. When the layer of deposited metal has reached the desired thickness, the mandrel is removed from the tank and processing of the electroformed article is completed, such as by rinsing, cooling and removal.

In the process of the present invention, where either one electrolytic cell or a plurality of electrolytic cells are used, it is desired, although not necessary, that the mandrel remain cathodic (or anodic, as appropriate) while the mandrel is being moved into and out of the respective electrolytic cell. That is, it is desired that the mandrel remain "hot" at least throughout the electroforming stages of the process. Maintaining the mandrel hot during the electroforming process helps to prevent the coating or deposit from being damaged such as by being redissolved in the electrolyte solution. For example, if a mandrel is made cathodic before it enters the electrolytic cell, current will start to flow through the system as soon as the cathodic mandrel contacts the anodizing electrolyte.

In embodiments of the present invention utilizing a plurality of electrolytic cells, such as in a carousel arrangement, it is further preferred that the current be adjusted for each individual mandrel as the respective mandrels enter and leave the electrolyte solution. For example, as a mandrel begins to leave the center of an electrolytic cell, the current transferred to the mandrel may be gradually decreased and then gradually increased as the mandrel approaches the center of the next electrolytic cell. In this instance, the current transferred to the mandrel is preferably at a minimum when the mandrel is equidistant from the center of two adjacent electrolytic cells.

In the above discussion, the current transferred to a mandrel in an electrolytic cell is discussed with reference to the mandrel entering and leaving the electrolytic cell. However, it is not necessary in the process of the present invention that the mandrel be completely removed from the electrolyte solution in a given electrolytic cell. For example, where two electrolytic cells are connected and the intervening wall removed, or in an electrolytic cell having two electroforming positions, the mandrel may either be removed from the electrolyte solution and moved to the next electroforming position, or the mandrel may be moved from one position to the next without being removed from the electrolyte solution.

In electroforming processes of the present invention, the electrolytic cell generally comprises two parallel walls, with an anode adjacent to each wall, defining a channel therebetween. Although the anodes may be of any width, and need not be continuous so as to specifically extend behind any shields that are used, preferred embodiments use anodes which are the entire width of the wall or anodes that themselves form the wall. Although the height of the anode is not particularly limited, the anodes are preferably at least as tall as the portion of the mandrel to be electroplated. If the anodes are shorter than the portion of the mandrel to be electroplated, then an uneven electroform layer may result on the mandrel surface.

In preferred embodiments of the present invention, the anodes are shielded by placing an appropriate shielding material in the channel between the anodes. Such shielding is placed in front of portions of the anodes so as to define a region of the channel between the two walls wherein the surface of the mandrel placed therein experiences substantially uniform current density. The shapes of the respective shields placed in the electrolytic cell may vary depending upon specific characteristics of the mandrel, electrolyte solution and process applications. For example, shields in the shape of a semicircle would be suitable for most applications. If the shielding is in the form of a semicircle, it is preferred that the semicircle be corrugated, i.e. sinusoidal, with the corrugations having an amplitude of less than 1/10 (peak to valley) of the size of the shield. For example, if a corrugated semicircle shield extends from the anode into the channel by two inches at its maximum, then the corrugations on the shield would not exceed more than 0.2 inches (peak to valley).

Figure 4:
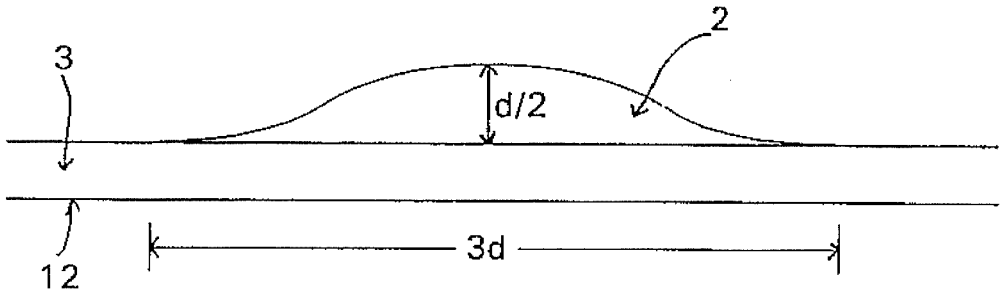
FIG. 4 is a schematic illustration of a shield of an electrolytic cell of FIG. 1.

A preferred shield design is a modified semicircle, such as that shown in FIG. 4. The shield is from about one to about four, preferably about three, times as wide as the mandrel diameter, extends into the electrolytic cell from the wall to a distance of from about ¼ to about two, preferably about ½, times the mandrel diameter and is radiused to the wall with from about ½ to 1½, preferably about 1, times the diameter of the mandrel. Preferably, the shields are three times as wide as the mandrel diameter, extend into the electrolytic cell from the wall to a distance of 0.5 times the mandrel diameter and are radiused to the wall with the same diameter as the mandrel.

If multiple shields are used in a single electrolytic cell, the shields are preferably placed directly opposite each other and adjacent to the respective anodes, For example, an imaginary line drawn through the center of the shields should be perpendicular to the anodes and/or walls of the electrolytic cell. In the case of embodiments arranged in a circular, elliptical or other manner, the imaginary line should be perpendicular to a line tangent to the curvature of the anodes and/or the walls of the electrolytic cell. Additionally, the shields may have different top-view profiles.

The shields may be fabricated from any nonporous, nonconductive or poorly conductive material, such as polypropylene, polyvinylchloride (PVC), or rubber. The shielding should be made from a material that is compatible with the electrolyte solution to be used in the electrolytic cell.

As described above, the present invention is directed either to a single electrolytic cell or to a plurality of electrolytic cells. For example, if a single electrolytic cell is used, the structure of the cell is completed by completing the rigid structure of the electrolytic tank, for example with side walls perpendicular to the first two walls. Alternatively, one or more electrolytic cells may be connected together, with or without dividing walls, to form a trough structure. If multiple cells are connected together, they may or may not be identical in structure, but may vary depending upon the particular requirements of the specific application.

Although the shape of the electrolytic cells is not particularly limited to any specific cell geometry, square or near-square geometries are preferred so as to permit the electrodeposition of a layer of uniform thickness onto the mandrel surface. Therefore, the size of the electrolytic cell is generally related to the size of the mandrel to be plated. Generally, the width of the electrolytic cell should be between about four and about twelve times the cross-sectional length of the mandrel, and the length of the electrolytic cell should also be from about four to about twelve times the cross-sectional length of the mandrel. Here, the cross-sectional length of the mandrel is meant to denote the longest cross-sectional distance of the mandrel. For example, if the mandrel is circular, the cross-sectional length will be the diameter; if the mandrel is elliptical, the cross-sectional length will be the length of the major axis of the ellipse. Preferably, the length and width of the electrolytic cell are between about six and about ten times the cross-sectional length of the mandrel. More preferably, the length and width of the electrolytic cell are about eight times the cross-sectional length of the mandrel.

One skilled in the art will recognize that the size of the electrolytic cell, as described above, may vary depending upon the specific electrolyte solution being used. For example, electrolytic cells as described above that are preferably about eight times the cross-sectional length of the mandrel, are preferred for systems wherein the electrolyte solution is sulfamic nickel, nickel/cobalt, cobalt, sulfate nickel, sulfate cobalt, sulfate copper, and solutions with similar conductivities. One skilled in the art will recognize that the size parameters of the electrolytic cell may be adjusted with only routine experimentation.

If two electrolytic cells are combined together as described above, then the length of the individual cells is preferably not changed from the above sizes. Therefore, where two cells are combined together in series, the total length of the cell will be about twice the length of the individual cells, and thus the distance between electrodeposition regions, where the mandrels are placed, is also about the length of an individual cell.

Electrolytic cell arrangements as described above generally allow the deposition of a uniform layer about 0.010 inch thick on the mandrel, with uniformity variations that do not exceed about 1.5% of the deposited layer thickness. In contrast, if the above-described shielding is not utilized to shield the anodes, the length and width of the electrolytic cell is preferably about 40 times the cross-sectional length of the mandrel.

Although, as described, use of shielding is not essential in some embodiments of the claimed invention, use of such shielding results in significant advantages and unexpected results. For example, as stated above, the preferred size of an electrolytic cell that does not use shielding is forty times the cross-sectional length of the mandrel, as compared to eight times the cross-sectional length of the mandrel for a cell utilizing shielding. If the described process is used to electroform a mandrel having a cross-sectional length of one foot, then the cell using shields may be square, measuring eight feet on each side, and having an area of 64 $ft^2$. If the cell does not use shields, however, the square would measure 40 ft. on each side, and have an area of 1,600 $ft^2$. Preferred embodiments therefore utilize shielding around portions of the anodes.

The shielding has several advantages, the most apparent being a significant reduction in size. The reduction in size creates further significant cost savings, resulting from less space utilization, less structural support to withstand the weight of the apparatus, and reduction in cost of electrolyte solution, processing, recovery and waste disposal. These advantages arise from the reduction in size of the apparatus, with the shielded cell occupying only 4% of the area of the unshielded cell.

When the mandrel is present in the electrolytic cell and electrodeposition is to be conducted, the electrolyte solution is preferably agitated to ensure that the mandrel surface is constantly exposed to new electrolyte solution. Such agitation may be conducted, for example, by stirring, air sparging, or solution flow. For example, in the case of solution flow, one side of the cell or trough of cells may be equipped with an electrolyte solution inlet valve, and the opposite side of the cell or trough may be equipped with an electrolyte solution outlet valve. In such an arrangement, the electrolyte solution would flow from one end of the cell or trough to the other end of the cell or trough, and then be recycled or otherwise processed.

The connector arm, which supports the mandrel in the electrolyte solution or other steps of the present invention, may be equipped with a current control. Such current control may be used to reduce, down to zero, if desired, the current which passes to the mandrel to cause the mandrel to become cathodic. Such current control may be connected to each individual connecting arm, where multiple connecting arms are utilized, or may be a central current control attached to all of the connector arms. However, it is preferred that a current control is independently connected to each connector arm, thereby allowing the electroforming process of each individual mandrel to be adjusted based upon such factors as the specific article being formed, the desired thickness of the deposited metal, and other factors. For example, a current control reducing the current to an intermediate value between zero and the maximum current would permit reduced electrodeposition upon the individual mandrel in the specific electrodeposition step. Similarly, a current control reducing the current to zero would cause the individual mandrel not to be cathodic, and so electrodeposition in a specific electrodeposition step would cease. Such current control could also be utilized to interrupt current flow to the mandrel in such other steps as rinsing, soaking, and removal of the electroform from the mandrel.

A further feature of the connecting arm in preferred embodiments of the present invention is that each connecting arm in an assembly of multiple connecting arms is capable of movement independent of the other connecting arms. For example, if multiple electrodeposition or other steps are combined in a carousel fashion, while all of the connecting arms proceed at the same rate in the horizontal direction through the various electroforming steps, each individual connecting arm is permitted to independently move up and down so as to withdraw or immerse the mandrel in respective solutions or expose the mandrel to other appropriate processes. Such up and down movement may be effected, for example, by the connector arm moving over a cam in the carousel apparatus.

One skilled in the art will readily recognize that the length of time for which each individual mandrel is suspended in the electrolytic solution, and the time between the various electroforming steps, will depend upon the specific electroform to be formed, the mandrels used, and the specific electrolytic solution. However, in embodiments of a preferred carousel arrangement of the present invention, the mandrels are moved quickly, e.g., within about one to about five seconds, between the electrodeposition areas. The mandrels are thus moved in a step fashion between the various sections of the electrodeposition process.

Furthermore, the above discussion describes the embodiments as having a cathodic mandrel and anodic electrodes. However, one skilled in the art will recognize that, in some instances, it may be desirable to make the electrodes cathodic and the mandrel anodic. Such change would require only minor adjustments to the disclosed process and apparatus.

Embodiments of the present invention will now be described in more detail with reference to the drawings.

FIG. 1 depicts a first embodiment of the present invention. FIG. 1 shows a connecting arm 1 suspending a mandrel 4 with a connector 5 in the electrodeposition solution 6 of an electrolytic cell 11. The mandrel 4 has a cross-sectional length (diameter) d, is suspended approximately in the center of the electrolytic cell 11, in a channel defined by two oppositely positioned shields 2 and two opposite walls 12. Adjacent to the walls 12 are positioned anode electrodes 3 connected to a DC power source 7. The structure of the electrolytic cell 11 is completed by positioning two side walls 8 approximately perpendicular to the walls 12. However, as described above, if two or more electrolytic cells are connected together, one or both of the side walls 8 may be removed (as in FIG. 5). The connecting arm 1 connects the mandrel 4 to a central shaft or other movement means, not shown, which provides for movement of the connecting arm 1 in the horizontal and vertical directions. Attached to the connecting arm 1 is a DC power source 10 through a current control 9 so as to selectively make the mandrel 5 cathodic.

Figure 2:
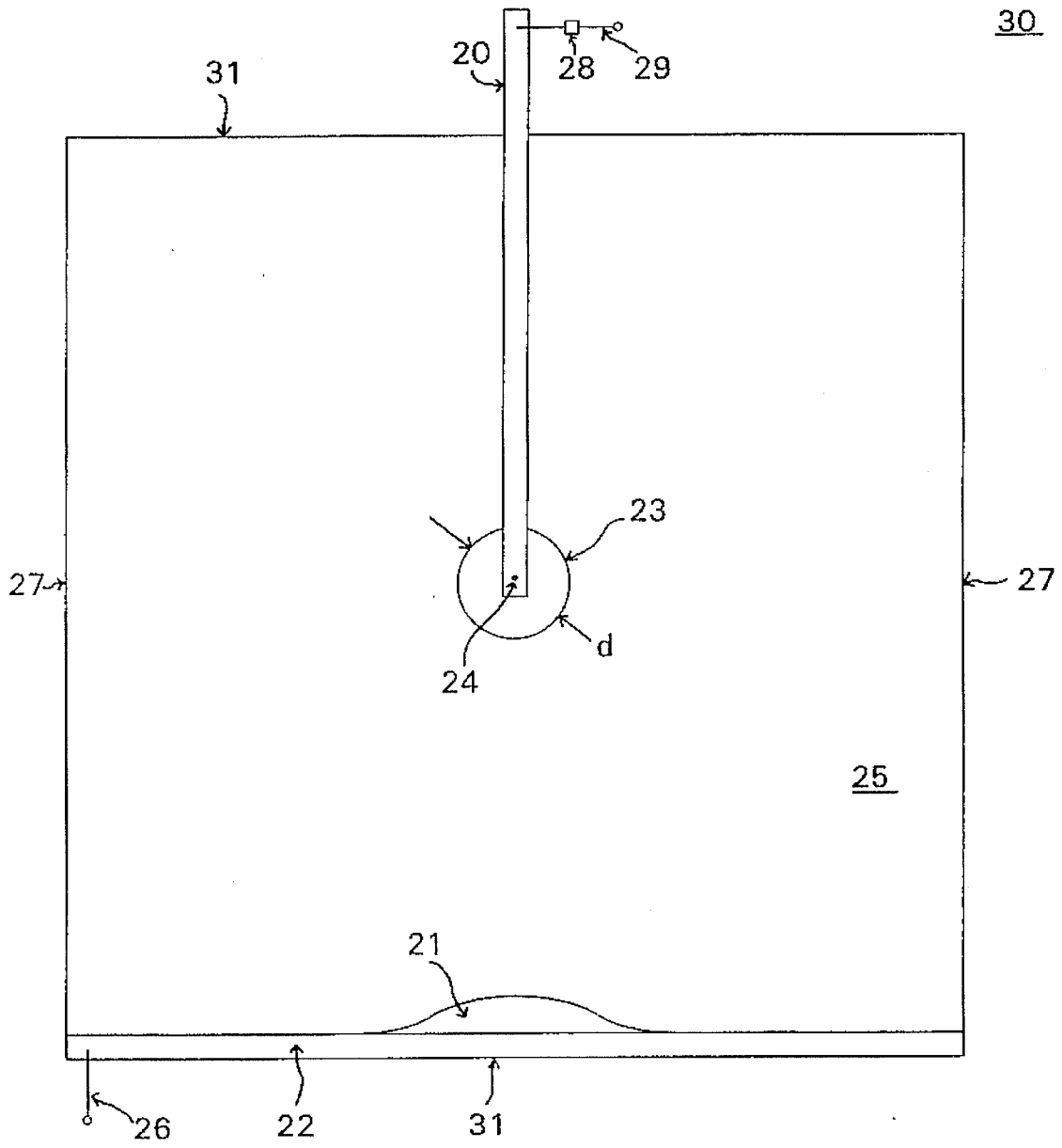
FIG. 2 is a schematic illustration of an electrolytic cell of an embodiment of the present invention having one anode electrode.

FIG. 2 depicts a second embodiment of the present invention. FIG. 2 shows a connecting arm 20 suspending a mandrel 23 with a connector 24 in the electrodeposition solution 25 of an electrolytic cell 30. The mandrel 23 has a cross-sectional length (diameter) d, is suspended approximately in the center of the electrolytic cell 30, in a channel defined by a shield 21 and a first wall 31, positioned opposite from a second wall 31. Adjacent to the first wall 31 are positioned anode electrodes 22 connected to a DC power source 26. The structure of the electrolytic cell 30 is completed by positioning two side walls 27 approximately perpendicular to the walls 31. However, as described above, if two or more electrolytic cells are connected together, one or both of the side walls 27 may be removed. The connecting arm 20 connects the mandrel 23 to a central shaft or other movement device, not shown, which provides for movement of the connecting arm 20 in the horizontal and vertical directions. Attached to the connecting arm 20 is a DE power source 29 through a current control 28 so as to selectively make the mandrel 23 cathodic.

Figure 3:
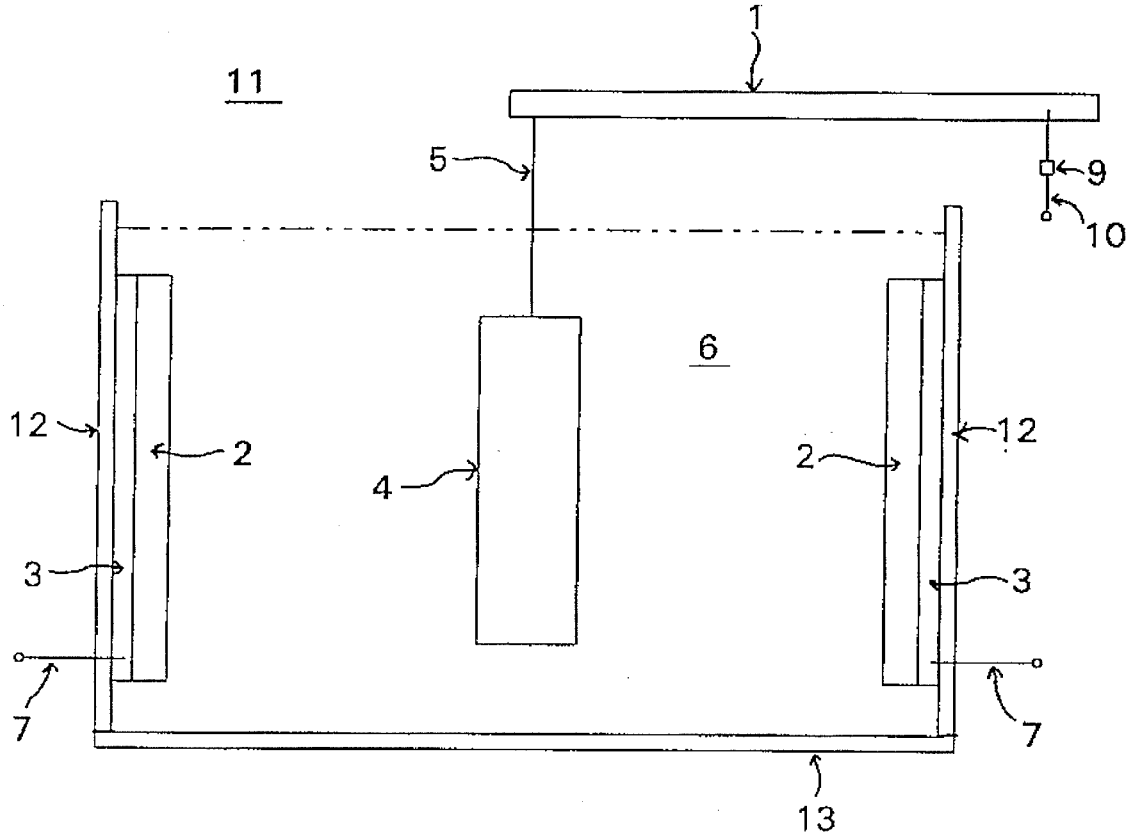
FIG. 3 is a schematic cross-sectional illustration of an electrolytic cell of FIG. 1.

FIG. 3 depicts a cross-sectional view of the electrolytic cell 11 of FIG. 1, along the cross-sectional line A as indicated. Parts in FIG. 3 are labelled with the same identification numbers as in FIG. 1. Additionally, FIG. 3 shows the base 13 of the electrolytic cell 11.

FIG. 4 depicts a shield for an electrolytic cell of FIG. 1. Parts in FIG. 4 are labelled with the same identification numbers as in FIG. 1. FIG. 4 shows the shield 2 covering a portion of the electrode 3 and wall 12. The shield 2 has a width of three times the cross-sectional length of the mandrel, extends into the channel to about one half the cross-sectional length of the mandrel and is radiused to the electrode 3 to the cross-sectional length of the mandrel.

Figure 5:
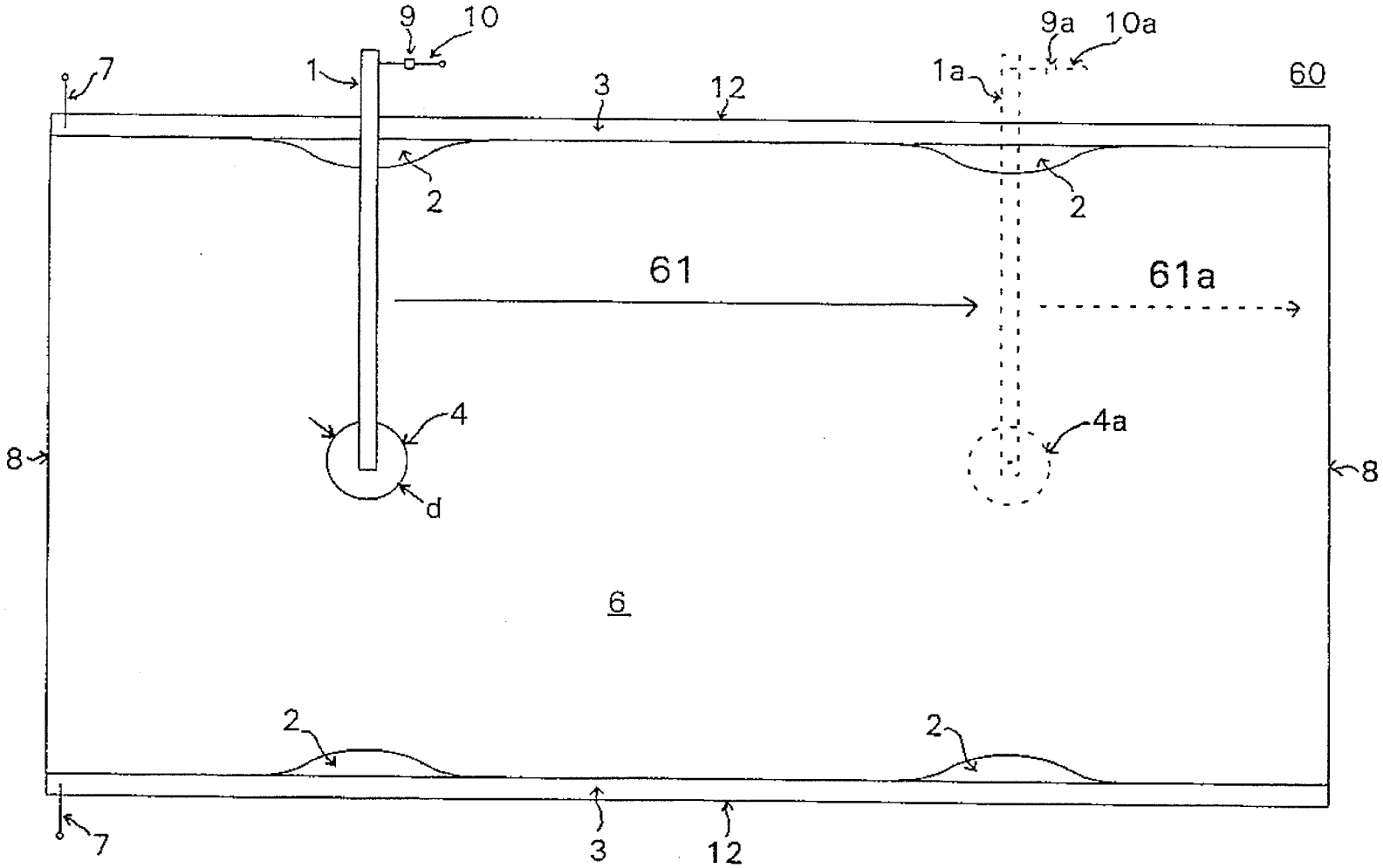
FIG. 5 is a schematic illustration of two electrolytic cells of FIG. 1 combined into a single apparatus.

FIG. 5 depicts two electrolytic cells of FIG. 1 combined into a single apparatus 60. Parts in FIG. 5 are labelled with the same identification numbers as in FIG. 1. FIG. 5 additionally shows that mandrel 4, supported in the electrodeposition solution 6 by connecting arm 1, may move from one electrodeposition region to another as shown by arrow 61. If a second connecting arm la supporting a mandrel 4*a* is located in the second electrodeposition region, it will move concurrently with mandrel 4 and connecting arm 1, in the direction of arrow 61*a*, to a further step in the electrodeposition apparatus (not shown). In this manner, multiple electrodeposition and other steps may be combined.

Figure 6:
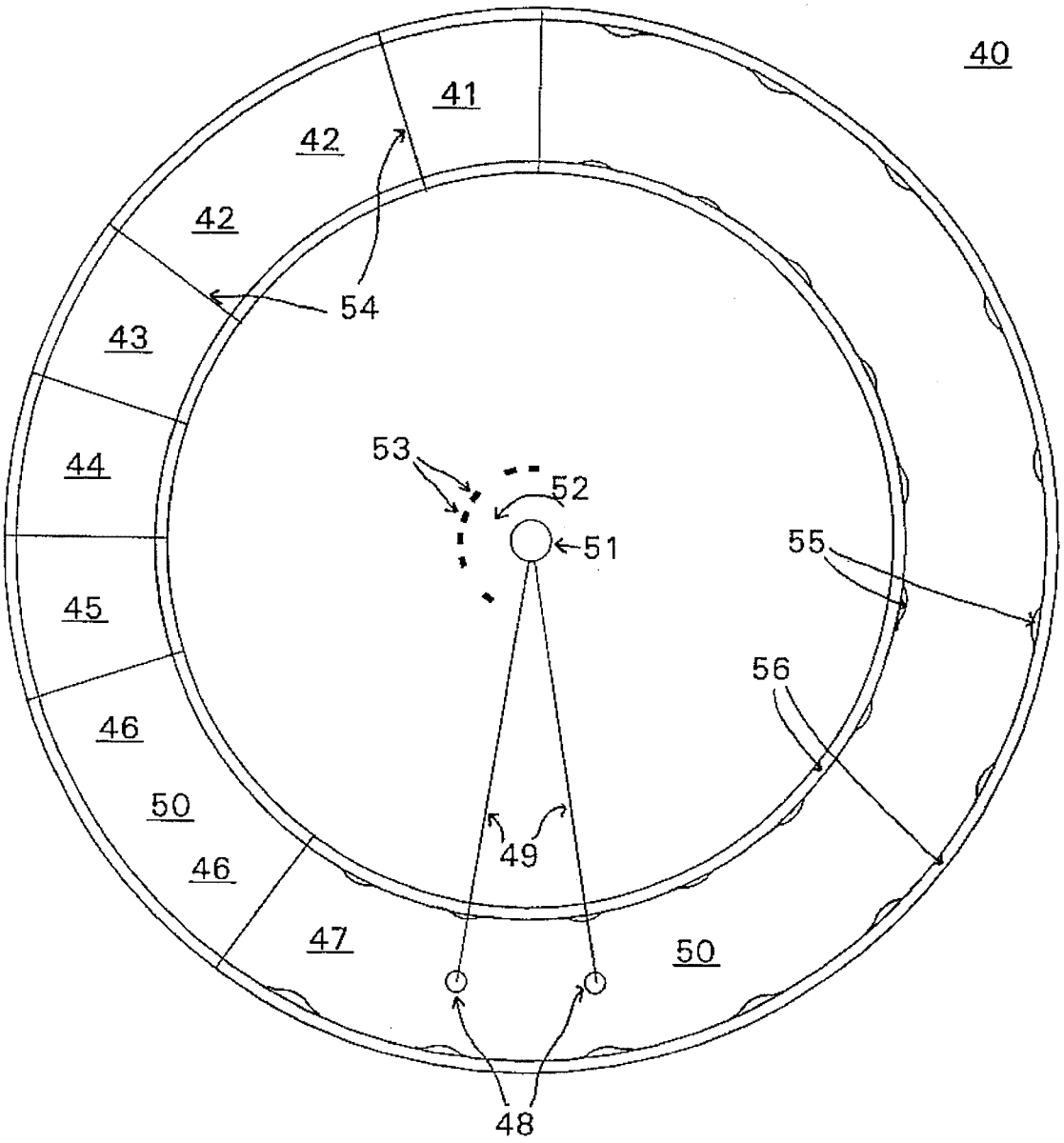
FIG. 6 is a schematic illustration of an embodiment of the present invention having multiple electroforming steps arranged in a carousel apparatus.

FIG. 6 depicts another embodiment of the present invention wherein multiple electrolytic cells and other electroforming steps are arranged in a carousel manner. The carousel 40 is composed of a mandrel cleaning stage 45, two adjacent hot soak stages 46, multiple electrodeposition stages 47, rinse stage 41, two cold soak stages 42, a second rinse stage 43 and an electroform removal stage 44. The electrolytic solution 50 is present in the hot soak stages 46 and the electrodeposition stages 47 and is preferably maintained at the same temperature. As shown in FIG. 1, each electrodeposition stage 47 contains two oppositely positioned shields 55 and anode electrodes 56. Mandrels 48 are attached to connector arms 49, which in turn are connected to a central rotating shaft 51. The rotating shaft 51 rotates in a step-wise manner, in the direction of arrow 52. Each individual connector arm 49 is capable of moving independently in the vertical direction, for example by moving over cams 53. For example, when a connector arm 49 moves over a cam 53, the connector arm 49 is raised to lift the mandrel 48 over individual stage walls 54.

EXAMPLES

Example 1

A single electrolytic cell is used to electroplate nickel on a zinc mandrel core. The major electrolyte components and process parameters are as follows:

Major Electrolyte Constituents:

Nickel sulfamate—$Ni^{+2}$ 8–12 oz/gal. (60–90 g/L)

Chloride—as $NiCl_2.6H_2O$, 1–7 oz/gal. (7.5–52.5 g/L)

Boric acid—5.0–5.4 oz/gal. (37.5–40.5 g/L)

pH—3.85–4.05 at 23° C.

Surface tension—at 136° F., 32–37 d/cm using sodium lauryl sulfate (about 0.00525 g/l)

Saccharin—0–1500 mg/L, as sodium benzosulfimide dihydrate

Lever—0–70 mg/L as 2-butyne-1,4-diol

Impurities—however, all impurities should be minimized:

Aluminum—0–20 mg/L

Ammonia—0∝400 mg/L

Arsenic—0–10 mg/L

Azodisulfonate—0–50 mg/L

Cadmium—0–10 mg/L

Calcium—0–20 mg/L

Hexavalent chromium—4 mg/L maximum

Copper—0–25 mg/L

Iron—0–250 mg/L

Lead—0–8 mg/L 2-methyl benzene sulfonamide—0–250 mg/L

Nitrate—0–10 mg/L

Organics—depends on the type; however, all known types need to be minimized

Phosphates—0–10 mg/L

Silicates—0–10 mg/L

Sodium—0–0.5 g/L

Sulfate—0–2.5 g/L

Zinc—0–5 mg/L

Operating Parameters:

Agitation rate—4–6 linear ft/sec solution flow over the cathode surface

Cathode (mandrel) current density—100–400 amps/$ft^2$; substantially uniform over the entire mandrel surface Ramp rise—0 to operating amps in 0 to 5 min.±2 sec.

Plating temperature at equilibrium—130+–155° F.

Anode—electrolytic, depolarized, or carbonyl nickel

Anode to cathode ratio—0.5:1 minimum

Mandrel core—aluminum, zinc, lead, cadmium, or stainless steel

The electrolytic cell is formed substantially as shown in FIG. 1. For a cylindrical mandrel having a diameter of 3 inches, the electrolytic cell is formed to have a channel between the two opposing shields of about 24 inches. In this example, the shields are made of polyvinyl chloride (PVC) and have the shape as shown in FIG. 4. The shields have a width of about 9 in., extend into the channel from the electrodes to about 1.5 in., and are radiused to the anode electrodes at about 3 in. After current to the mandrel and electrolytic cell is activated, the cathodic mandrel is immersed in the electrolytic cell and vertically suspended between the anode electrodes. The mandrel is not rotated during the electrodeposition process. After the desired thickness is deposited on the mandrel, the mandrel is removed from the electrolyte solution, current to the mandrel is deactivated, the mandrel is rinsed and washed and the electroformed product is removed from the mandrel. This process forms a uniform deposit of nickel on the mandrel surface having a thickness of about 0.010 in., with uniformity variations not exceeding 1.5% of the deposited nickel thickness.

Example 2

The electrodeposition process of Example 1 is repeated, except that the single electrolytic cell is replaced by a carousel apparatus. The carousel apparatus comprises, in sequence, a mandrel cleaning station, a hot soak station, multiple electrodeposition stations, a first rinse station, a cold soak station, a second rinse station, and an electroform removal station. The hot soak and cold soak stations each contain an electrolyte solution similar to that used in the electrodeposition stations, except that the hot and cold soak stations do not contain electrodes. The hot soak station is maintained at the same temperature as the electrodeposition stations, and the cold soak station is maintained at a temperature around room temperature. The electrodeposition stations are arranged in a single electrolytic cell, such as described in FIG. 6. Agitation of the electrolyte solution is achieved by introducing fresh electrolyte solution into the electrolytic cell through an inlet valve in the first electrodeposition station, and withdrawing solution from the cell through an outlet valve in the last electrodeposition station. As in Example 1 above, the channel defined by two opposing electrode shields is about 24 inches (eight times the mandrel diameter of 3 inches). The distance between each electrodeposition station in the electrolytic cell, i.e., the distance between the centers of adjacent electrode shields, is also about 24 inches.

Multiple products are electroformed at the same time using the carousel apparatus. Each individual mandrel is attached to a connecting arm, with separate current control means to activate or deactivate current to the mandrel depending on its location in the electrodeposition apparatus. Each connector arm is capable of independent vertical movement, to lift the respective mandrel out of a corresponding solution, but all of the connector arms move simultaneously in the horizontal direction, i.e., from one station to the next.

Electrodeposition is conducted using an electrolyte solution and process parameters as described in Example 1. In this process, the mandrels are maintained cathodic during their progress from one electrodeposition station to another electrodeposition station, and the mandrels are not rotated during the electrodeposition process. This carousel electrodeposition process produces a nickel layer of about 0.010 inches thick on the mandrel with uniformity variations not exceeding about of the deposited nickel thickness.

Example 3

A single electrolytic cell is formed as in Example 1, except that the major electrolyte components and process parameters are set as follows:

Major Electrolyte Constituents:

Nickel sulfamate—$Ni^{+2}$, 11.5 oz/gal.

Chloride—as $NiCl_2.6H_2O$, 2.5 oz/gal.

Boric acid—5.0 oz/gal.

pH—3.95 at 23° C.

Surface tension—at 136° F., 35 d/cm using sodium lauryl sulfate (about 0.00525 g/l)

Saccharin—100 mg/L, as sodium benzosulfimide dihydrate

Lever—2-butyne-1,4-diol, as required up to 70 mg/L

Impurities—all listed impurities are eliminated, at 0 mg/L

Operating Parameters:

Agitation rate—6 linear ft/sec solution flow over the cathode surface

Cathode (mandrel) current density—250 amps/$ft^2$; substantially uniform over the entire mandrel surface Ramp rise—0 to operating amps in 1 min.±2 sec.

Plating temperature at equilibrium—140° F.

Anode—carbonyl nickel

Anode to cathode ratio—2:1

Mandrel core—zinc

The electrolytic cell is formed substantially as shown in FIG. 1 and described in Example 1. As in Example 1, the mandrel is not rotated during the electrodeposition process. After the desired thickness is deposited on the mandrel, the mandrel is removed from the electrolyte solution, current to the mandrel is deactivated, the mandrel is rinsed and washed and the electroformed product is removed from the mandrel. This process forms a uniform deposit of nickel on the mandrel surface having a thickness of about 0.010 in., with uniformity variations not exceeding 1.5% of the deposited nickel thickness.

What is claimed is:

1. An apparatus for depositing metal or metal alloy on a mandrel comprising:

an electrode comprised of a first wall;

a second wall spaced from the first wall;

a channel defined by the first wall and the second wall;

an electrically nonconductive shield disposed adjacent to and covering a portion of the first wall wherein the shield defines a region of the channel wherein a surface of a mandrel placed in said region experiences substantially uniform current density and wherein the channel has a width ranging in size from about four times to about twelve times a cross-sectional length of the mandrel.

2. An apparatus for depositing metal or metal alloy on a mandrel comprising:

a first electrode;

a second electrode spaced from the first electrode;

a channel defined by the first electrode and the second electrode;

a first electrically nonconductive shield disposed adjacent to and covering a portion of the first electrode; and a second electrically nonconductive or poorly conductive shield disposed adjacent the second electrode and disposed opposite the first shield;

wherein there is defined between the first shield and the second shield a first region of the channel wherein a surface of a mandrel placed in said first region experiences substantially uniform current density and wherein the channel has a width ranging in size from about four times to about twelve times a cross-sectional length Of the mandrel.

3. The apparatus of claim 2, further comprising a transport device for moving a mandrel, wherein said transport device allows for a mandrel attached thereto to move into and out of said first region.

4. The apparatus of claim 3, wherein the apparatus and the transport device lack a device to rotate a mandrel attached to said transport device.

5. The apparatus of claim 4, further comprising a mandrel selectively attachable to said transport device.

6. The apparatus of claim 2, wherein the first shield is disposed directly opposite the second shield.

7. The apparatus of claim 2, wherein the first and second shields comprise at least one member selected from the group consisting of polypropylene, polyvinylchloride and rubber.

8. The apparatus of claim 2, wherein the first shield and the second shield have different top-view profiles.

9. The apparatus of claim 2, wherein the first shield and the second shield are in the form of semicircles.

10. The apparatus of claim 5, wherein the first shield and the second shield are formed to have a width of between about one and four times a cross-sectional length of the mandrel, extend into the channel to between about ¼ and two times the cross-sectional length of the mandrel and are radiused to the first and second electrodes of between about ½ and 1½ times the cross-sectional length of the mandrel.

11. The apparatus of claim 10, wherein the first shield and the second shield are formed to have a width of about three times the cross-sectional length of the mandrel, extend into the channel to about ½ times the cross-sectional length of the mandrel and are radiused to the first and second electrodes to about the cross-sectional length of the mandrel.

12. The apparatus of claim 5, wherein the channel has a width of from about six to about ten times cross-sectional length of the mandrel.

13. The apparatus of claim 2, further comprising a current control to control an amount of current transferred to a mandrel placed in said first region.

14. The apparatus of claim 2, wherein said first and second electrodes are anode electrodes.

15. The apparatus of claim 2, further comprising a second region of the channel wherein the surface of a mandrel placed therein experiences substantially uniform current density, wherein said second region is defined by a third electrically nonconductive shield disposed adjacent to and covering a portion of a third electrode and spaced from the first shield, and is opposite the channel from a fourth electrically nonconductive or poorly conductive shield disposed adjacent a fourth electrode and spaced from the second shield.

16. The apparatus of claim 15, wherein the a distance separating a center of the first region from a center of the second region ranges from about four to about twelve times a cross-sectional length of a mandrel placed in either region.

17. The apparatus of claim 15, further comprising a transport device for moving a mandrel, wherein said transport device allows for a mandrel attached thereto to move from the first region to the second region.

18. The apparatus of claim 17, further comprising a mandrel selectively attachable to said transport device, wherein said transport device moves said mandrel in a step-wise manner from the first region to the second region.

19. The apparatus of claim 15, wherein said first and third electrodes form a first continuous electrode and said second and fourth electrodes form a second continuous electrode.

20. A process for electrodepositing metal or metal alloy upon a mandrel, comprising:

positioning a mandrel in a first region of substantially uniform current density in an electrolytic cell comprising a first electrode, a second electrode spaced opposite from said first electrode, a first shield adjacent to and covering a portion of said first electrode, and a second shield adjacent to said second electrode and opposite from said first shield, thereby defining said first region of substantially uniform current density;

activating current to said electrolytic cell; and electrodepositing a metal or metal alloy onto a surface of said mandrel;

wherein a channel defined by the first electrode and the second electrode has a width ranging in size from about four times to about twelve times a cross-sectional length of the mandrel.

21. A process according to claim 20, further comprising moving said mandrel to a second region of substantially uniform current density in said electrolytic cell, said second region defined by a third shield adjacent to and covering a portion of a third electrode and spaced from said first shield and a fourth shield adjacent to a fourth anode electrode and spaced from said second shield.

22. A process according to claim 21, wherein said mandrel is removed from said electrolytic cell during its movement from said first region to said second region.

23. A process according to claim 21, wherein said mandrel is moved from said first region to said second region in a step-wise manner.

24. The apparatus of claim 21, wherein said first and third electrodes form a first continuous electrode and said second and fourth electrodes form a second continuous electrode.

25. Apparatus for electrodepositing metal or metal alloy upon a mandrel, comprising:

means for positioning a mandrel in a first region of substantially uniform current density in an electrolytic cell, said electrolytic cell comprising a first electrode, a second electrode spaced opposite from said first electrode, a first shield adjacent to and covering a portion of said first electrode, and a second shield adjacent to and covering a portion of said second electrode and opposite from said first shield, thereby defining said first region of substantially uniform current density;

means for activating current to said electrolytic cell; and means for electrodepositing a metal or metal alloy onto a surface of said mandrel;

wherein a channel defined by the first electrode and the second electrode has a width ranging in size from about four times to about twelve times a cross-sectional length of the mandrel.

26. The apparatus of claim 2, wherein said first shield and said second shield are each at least as tall as a portion of said mandrel to be electrodeposited.

* * * * *